United States Patent [19]

Rees

[11] 4,222,922

[45] Sep. 16, 1980

[54] WARP SIZE FOR FILAMENT YARN CONSISTING ESSENTIALLY OF POLYVINYL ALCOHOL HAVING A DEGREE OF HYDROLYSIS OF 88–100%, QUATERNARY AMMONIUM SURFACTANT AND PLASTICIZER

[75] Inventor: Richard W. Rees, Wilmington, Del.

[73] Assignee: E. I. Du Pont De Nemours and Company, Wilmington, Del.

[21] Appl. No.: 973,624

[22] Filed: Dec. 27, 1978

Related U.S. Application Data

[63] Continuation-in-part of Ser. No. 901,852, May 1, 1978, abandoned.

[51] Int. Cl.[2] ..... C08L 29/04

[52] U.S. Cl. ..... 260/29.6 BE; 260/32.6 R; 427/154

[58] Field of Search ..... 260/29.6 BE, 29.6 N, 260/32.6 R

[56] References Cited

U.S. PATENT DOCUMENTS

| | | | |
|---|---|---|---|
| 2,340,866 | 2/1944 | Danglemajer | 260/29.6 BE |
| 3,087,920 | 4/1963 | Suzumura et al. | 260/29.6 BE |
| 4,131,581 | 12/1978 | Coker | 260/29.6 BE |

*Primary Examiner*—Joseph L. Schofer
*Assistant Examiner*—Peter Kulkosky

[57] ABSTRACT

An improved warp size for filament yarn is provided consisting essentially of polyvinyl alcohol, alkyl phenoxy (or cresoxy) ethoxyethyl dimethylbenzyl ammonium chloride and a plasticizer such as glycerol or urea, which when applied to filament yarn from aqueous solution provides excellent weaving efficiency and ease of removal combined with low shedding in the loom.

10 Claims, No Drawings

WARP SIZE FOR FILAMENT YARN CONSISTING ESSENTIALLY OF POLYVINYL ALCOHOL HAVING A DEGREE OF HYDROLYSIS OF 88–100%, QUATERNARY AMMONIUM SURFACTANT AND PLASTICIZER

This is a continuation-in-part of copending application Ser. No. 901,852, filed on May 1, 1978, now abandoned.

BACKGROUND OF THE INVENTION

1. Field of the Invention

This invention relates to warp sizes and more specifically it relates to an improved warp size for filament yarns based upon polyvinyl alcohol.

2. Description of the Prior Art

Polyvinyl alcohol (PVA) has been tried, repeatedly, as a warp size for polyester filament yarn but has been rejected due to the undesirable quantity of "shed" that accumulates on the loom. This "shed" consists of fragments of the size that are scraped off the individual yarns by the various areas of high abrasion encountered in weaving, for example the reciprocating action of the reed. As a consequence of this serious problem, PVA is not used as the principle ingredient in polyester filament yarn sizing.

SUMMARY OF THE INVENTION

According to the present invention there is provided a composition consisting essentially of (a) about 100 parts by weight of polyvinyl alcohol having a degree of hydrolysis of from about 88 to about 100 mol % and a solution viscosity of from about 5 to about 50 mPa.s measured as a 4% aqueous solution at a temperature of 20° C., (b) from about 0.5 to about 10 parts by weight of cationic surfactant selected from the group consisting of alkyl phenoxyethoxyethyl dimethylbenzyl ammonium chlorides and alkyl cresoxyethoxyethyl dimethylbenzyl ammonium chlorides wherein the alkyl group has 2 to 12 C atoms, and (c) from about 4 to about 50 parts by weight of plasticizer selected from the group consisting of polyhydric alcohol having up to 3 hydroxyl groups and up to 8 C atoms and urea.

Further provided according to the present invention is the above composition in the form of an aqueous solution having a solids content of from about 3 to about 25% by weight.

DETAILED DESCRIPTION OF THE INVENTION

Information from publications and experts in the field suggested that a high level of adhesion to the fiber substrate was essential for a good aqueous-based size. (C. R. Blumenstein: "An Introduction To The Chemistry And Evaluation of Polymeric Sizes For Filaments" *Textile Chemist & Colorist,* March 1971).

U.S. Pat. No. 3,860,553 teaches that PVA sizes are extremely poor in adhesion to polyester. Surprisingly, however, excellent performance was achieved on polyester filament yarn by the improved warp size of the present invention by employing a specific type of cationic surfactant and plasticizer selected from the group consisting of polyhydric alcohol and urea in combination with PVA. Excellent weaving efficiency, ease of removal and low shedding in the loom was obtained.

The polyvinyl alcohol employed in the composition of the present invention should have a degree of hydrolysis of from about 88 to 100 mol % and should have a 4% aqueous solution viscosity in the range of from about 5 to about 50 mPa.s. Preferably the 4% solution viscosity is from about 10 to about 35 mPa.s.

The polyvinyl alcohol can be either a homopolymer or a copolymer. Copolymers can be obtained by alcoholysis (hydrolysis saponification) of copolymers of vinyl acetate with minor quantities of other comonomers, such as acrylate esters, methacrylate esters, maleate esters and alpha-olefins. The mol % range of such comonomer units is from 0 to about 12% in the PVA.

The cationic surfactant suitable for the present invention is selected from alkyl cresoxyethoxyethyl dimethylbenzyl ammonium chlorides wherein the alkyl group has 2 to 12 carbon atoms. Preferred cationic surfactants are diisobutyl phenoxyethoxyethyl dimethylbenzyl ammonium chloride ("Hyamine 1622", available from Rohm and Haas) and diisobutyl cresoxyethoxyethyl dimethylbenzyl ammonium chloride ("Hyamine 10-X", available from Rohm and Haas). The chemical Abstract nomenclature for "Hyamine 1622" and "Hyamine 10-X" is N,N-dimethyl-N-[2-[2-[4-(1,1,3,3-tetramethyl butyl) phenoxy]ethoxy]ethyl]benzenemethanaminium chloride and N,N,-dimethyl-N-[2-[2-[4-(1,1,3,3,-tetramethyl butyl) cresoxy]ethoxy]ethyl]benzenemethanaminium chloride respectively.

The "Hyamine" surfactant should be present in the amount of from about 0.5 to about 10 parts by weight based upon 100 parts of PVA. Preferably the "Hyamine" surfactant is present in the amount of from about 1.0 to about 3.5 parts by weight per 100 parts of PVA.

The third ingredient is plasticizer selected from the group consisting of polyhydric alcohol which has up to three hydroxyl groups and up to 8 carbon atoms and urea. Suitable polyhydric alcohols include glycerol, ethylene glycol, propylene glycol, dipropylene glycol, diethylene glycol, triethylene glycol and diethylpropanediol. The most preferred plasticizers are glycerol and urea. Texturized polyester yarns exhibit wide variations in surface and physical characteristics. For tender, low strength, zero-twit yarns, selection of glycerol as the plasticizing ingredient gives the best results (as in Example 3 below). In the case of highly crimped, high denier yarns, as in Example 9 below, urea is preferred over glycerol.

The amount of plasticizer in the warp size composition of the present invention should be from about 4 to about 50 parts by weight based upon 100 parts by weight of PVA. Preferably the plasticizer should be present in the amount of from about 8 to about 25 parts by weight per 100 parts of PVA.

For certain styles of yarn and fabric the PVA based warp size of the present invention can also be used advantageously in combination with other aqueous sizes, such as acrylic polymers or polyester dispersions.

Of course, optionally other ingredients, for example lubricating agents, such as self-emulsifying low melting waxes may be included in the warp size of the present invention as one might desire without materially affecting the basic and novel characteristics of the present warp sizing composition.

The warp sizing of the present invention is applied to the filament yarn from an aqueous solution having a solids content of from about 3 to about 25 weight percent, preferably from about 5 to about 12 weight percent, by well-known slashing mehods.

The temperature of the size solution should be between 40° and 90° C. Either single or multiple size boxes may be used. After removal of excess size solution by passage between squeeze rolls, the sized yarn is dried by contact with multiple drying cans heated to temperatures of 100° to 125° C., split by stationary lease rods, and wound as a weaving beam. The slashing operation is conducted at speeds of 10 to 100 meters/min. Essential properties of the size include (a) absence of excessive foaming in the size box, (b) no sticking of polymer to the drying can, (c) clean splitting at the lease bars without breakage of ends or filaments, and (d) easy separation of the sized yarns when entering into the loom harness.

Weaving may be performed with conventional shuttle looms, air-jet looms, rapier looms or shuttle-less weaving machines. Essential characteristics are (a) production of first-quality cloth, (b) loom efficiency of 90% or greater, and (c) absence of loom fouling by powdery or paste-like deposits.

During finishing, the size is removed by scouring with detergent solutions and hot water. It is highly desirable that the size should be completely removed from the cloth, using water at moderate temperatures (50°–80° C.), without the use of chemical additives such as sodium hydroxide or carbonate.

All these desired characteristics are obtained by the use of the compositions disclosed in this application.

The following examples are given for the purpose of illustrating the present invention. All parts and percentages are by weight unless otherwise specified.

EXAMPLE 1

A solution of 10 g of polyvinyl alcohol (degree of hydrolysis 99.0–99.8 mol %, 4% aqueous solution viscosity at 20° C. 27 mPa.s) 0.2 g of "Hyamine 1622" and 1.0 g of glycerol in 115 g of water was prepared by stirring for one hour at 70° C. The solution was clear and deposited a flexible stretchable film when dried. It was maintained at 70° C. while about a 30 m length of smooth filament polyester yarn was passed through it, followed by hot air drying. The slashed yarn was compact and exhibited excellent resistance to abrasion.

EXAMPLE 2

Identical to Example 1, except the amount of glycerol employed was 1.3 g. The slashed yarn was compact and exhibited excellent resistance to abrasion.

EXAMPLE 3

A solution of 45.36 kg of polyvinyl alcohol employed in Example 1, 0.92 kg of "Hyamine 1622" and 2.95 kg of glycerol in 0.26 $m^3$ of water was prepared by stirring at 80° C. in a commerical cooking kettle. The solution was then transferred to a commerical Coleman Cocker slasher and was applied to 1000 m of air-entangled texturized polyester yarn (3726 ends). Operating characteristics were satisfactory, and no end-breaks or filament breakage occurred. The slashed yarn was stiff, smooth and well bonded. Size add-on was 12% (based on yarn weight). Cloth was woven from the slashed warp, using a high speed Sulzer shuttle-less weaving machine. Weaving efficiency was over 90% and the quantity of shed was sufficiently small to cause no problems. Quality of the cloth was excellent. The cloth was finished in a conventional range and outstanding size removal was observed.

EXAMPLE 4

Example 3 was repeated, except that solution solids content was reduced from 10% to 7.5% and a high speed West Point slasher was used instead of the Coleman Cocker slasher. 3728 ends were slashed, with no breaks or broken filaments. The weaving proceeded at 95.4% efficiency, with negligible shedding, and size removal was excellent. The add-on of size was 4.7% in this test.

EXAMPLES 5 TO 8

The experiments tabulated below were conducted with a small Callaway slasher, operating on 100 ends of texturized polyester yarn. Abrasion resistance was measured by a reciprocating reed tester, operating at 1 cycle per second for 15 minutes. Size compositions were applied from an aqueous solution having a solids content of 8.7–9% by wt.

| | Size Composition, parts by wt. | | | | Size |
|---|---|---|---|---|---|
| Ex. | PVA | "Hyamine 1622" | Glycerol | Resistance to Shedding | Add-on wt. % |
| 5 | 100 | 2 | 13 | Excellent | 9.5–10 |
| 6 | 100 | 2 | 18 | Very good. | 9.5–10 |
| 7 | 100 | 2 | 22 | Good. | 9.5–10 |
| 8 | 100 | 1 | 13 | Fairly good. | 9.5–10 |

CONTROL EXAMPLE A

Ommission of "Hyamine 1622" from Example 1 gave a limp yarn, with surface blisters, and a tendency to stick together on the beam due to surface tackiness. Bonding was fairly poor, and abrasion resistance was only fair.

CONTROL EXAMPLE B

Substitution of dimethyl distearyl ammonium chloride for "Hyamine 1622" in Example 1 gave a limp, hairy yarn having poor resistance to abrasion.

CONTROL EXAMPLE C

The same blend described in Example 3 was run under the same conditions, except that the glycerol was omitted. Operating characteristics were quite satisfactory, and weaving efficiency was over 90%. However, heavy shedding occurred during weaving so that the loom reed and other components were covered with a deposit of fibrous particles. Careful cleaning of the loom was needed before further weaving could be carried out.

CONTROL EXAMPLE D 420 g of polyvinyl alcohol employed in Example 1, 10 g of dimethyl distearyl ammonium chloride, and 62 g of glycerol was dissolved in 5500 $cm^3$ water, and was applied to texturized polyester yarn in the Callaway slasher to give an add-on of 8.6% by wt. Abrasion testing produced a copious deposit of shed on the reed. The cationic content was then increased by adding 5.0 g [total 15 g]. Add-on was 8.1% and abrasion resistance was marginally improved, but still unsatisfactory.

In the same series of experiments, 420 g of polyvinyl alcohol, 8.4 g of "Hyamine 1622", and 55 g of glycerol gave a yarn with 9.3% add-on which produced only very light, non-fibrous shed when tested under the same conditions.

CONTROL EXAMPLE E 350 g of PVA employed in Example 1 and 70 g of dimethyl distearyl ammonium chloride as dissolved in 5580 $cm^3$ of water and was slashed on texturized polyester yarn. Abrasion testing produced a heavy deposit of fibrous shed on the reed.

CONTROL EXAMPLE F 10 g of PVA employed in Example 1 and 2 g of N-alkyl trimethyl ammonium chloride ("Arquad 18-15" available from Armak Company) were dissolved in 140 ccs water. The viscous solution was cast on a Mylar® polyester sheet and allowed to dry. The film was very soft and exhibited poor abrasion resistance and adhesion.

EXAMPLE 9

A 10% solids solution of size was prepared from the following solid ingredients: PVA employed in Example 1, "Hyamine" 1622 and urea in the proportions of 100:2:13 parts by weight by stirring and heating to 85° C. This size was used to slash four different types of texturized polyester yarn and one type of non-texturized polyester yarn. In each example, 50 ends were slashed, using a small Callaway slasher. In all cases, satisfactory operation was observed with no breakage of filaments. The yarns were all stiff and compact, with adequate characteristics for entering into a loom. Abrasion tests, using a reciprocating reed tester, demonstrated very light to moderate shedding in four out of the five examples. The fifth yarn contained an excessive quantity of processing oil so filament bonding was somewhat deficient. This test demonstrated excellent performance for most types of texturized yarn and for smooth filament yarn.

EXAMPLE 10

A 19.3% solids solution of size comprising PVA employed in Example 1, "Hyamine" 1622 and urea in the proportions of 100:2:13 parts by weight was prepared by stirring and heating to 88° C. This viscous solution was diluted to 10% solids and used to slash 4000 ends of 150 denier texturized polyester yarn. 2000 meters of slashed yarn were collected as a beam, and woven on a Sulzer loom. Good weaving efficiency was recorded (90%) and the level of shedding was desirably low. Size add-on was 7.8%.

I claim:

1. A composition consisting essentially of (a) about 100 parts by weight of polyvinyl alcohol having a degree of hydrolysis of from about 88 to about 100 mol % and a solution viscosity of from about 5 to about 50 mPa.s measured as a 4% aqueous solution at a temperature of 20° C., (b) from about 0.5 to about 10 parts by weight of cationic surfactant selected from the group consisting of alkyl phenoxyethoxyethyl dimethylbenzyl ammonium chlorides and alkyl cresoxyethoxyethyl dimethylbenzyl ammonium chlorides wherein the alkyl group has 2 to 12 carbon atoms, and (c) from about 4 to about 50 parts by weight of plasticizer selected from the group consisting of polyhydric alcohol having up to 3 hydroxyl groups and up to 8 carbon atoms, and urea.

2. The composition of claim 1 wherein said polyvinyl alcohol has a solution viscosity of about 10 to about 35 mPa.s.

3. The composition of claim 2 wherein said cationic surfactant is selected from the group consisting of diisobutyl phenoxyethoxyethyl dimethylbenzyl ammonium chloride and diisobutyl cresoxyethoxyethyl dimethylbenzyl ammonium chloride.

4. The composition of claim 3 wherein said cationic surfactant is present in the amount of from about 1.0 to about 3.5 parts by weight.

5. The composition of claim 4 wherein said plasticizer is urea.

6. The composition of claim 4 wherein said polyhydric alcohol is selected from the group consisting of glycerol, ethylene glycol, propylene glycol, dipropylene glycol, diethylene glycol, triethylene glycol, and diethylpropanediol.

7. The composition of claim 6 wherein said polyhydric alcohol is glycerol.

8. The composition of claims 5, 6 or 7 wherein said plasticizer is present in the amount of from about 8 to about 25 parts by weight.

9. The composition of claims 1, 4, 5 or 7 in the form of an aqueous solution having a solids content of from about 3 to about 25% by weight.

10. The composition of claim 9 having a solids content of from about 5 to about 12% by weight.

* * * * *